US006635347B1

(12) United States Patent
Yoshida

(10) Patent No.: US 6,635,347 B1
(45) Date of Patent: Oct. 21, 2003

(54) BLENDED DYED PRODUCT OF FIBER DYEABLE WITH DISPERSE DYE AND POLYURETHANE FIBER AND DYEING METHOD THEREFOR

(75) Inventor: Kiyoshi Yoshida, Suita (JP)

(73) Assignee: Asahi Kasei Kabushiki Kaisha, Osaka (JP)

( * ) Notice: Subject to any disclaimer, the term of this patent is extended or adjusted under 35 U.S.C. 154(b) by 0 days.

(21) Appl. No.: 09/831,946

(22) PCT Filed: Nov. 18, 1999

(86) PCT No.: PCT/JP99/06431

§ 371 (c)(1),
(2), (4) Date: May 16, 2001

(87) PCT Pub. No.: WO00/29664

PCT Pub. Date: May 25, 2000

(30) Foreign Application Priority Data

Nov. 18, 1998 (JP) ..... 10-328222
Nov. 18, 1998 (JP) ..... 10-328228
Sep. 29, 1999 (JP) ..... 11-275993

(51) Int. Cl.[7] ..... D02G 3/00; D06P 5/12

(52) U.S. Cl. ..... 428/395; 428/375; 428/378; 428/394; 8/456; 8/464; 8/115.7; 8/920; 8/922; 8/926

(58) Field of Search ..... 428/375, 378, 428/394, 395; 8/451, 456, 464, 466, 115.7, 920, 922, 924, 926, 930

(56) References Cited

U.S. PATENT DOCUMENTS 5,456,960 A * 10/1995 Ido et al. ..... 428/36.1
5,512,059 A * 4/1996 Ido et al. ..... 8/115.7
5,738,688 A * 4/1998 De Lathauwer ..... 8/115.56
6,024,770 A * 2/2000 De Lathauwer ..... 8/595

FOREIGN PATENT DOCUMENTS

| | | |
|---|---|---|
| EP | 0 489 395 | 6/1992 |
| JP | J50031178 | 3/1975 |
| JP | J58149375 | 9/1983 |
| JP | 62-38479 | 8/1987 |
| JP | 04-41754 | 2/1992 |
| JP | 04-185713 | 7/1992 |
| JP | 05-279971 | 10/1993 |
| JP | 05-295673 | 11/1993 |
| JP | 06-294078 | 10/1994 |
| JP | 08-209554 | 8/1996 |
| JP | 09-324346 | 12/1997 |
| JP | 11-172584 | 6/1999 |

* cited by examiner

*Primary Examiner*—Marie Yamnitzky
*Assistant Examiner*—J. M. Gray
(74) *Attorney, Agent, or Firm*—Finnegan, Henderson, Farabow, Garrett & Dunner, L.L.P.

(57) ABSTRACT

A mixed fiber article dyed with disperse dye, composed of fiber dyeable with disperse dye and polyurethane fiber, having a color fastness to a perspiration-alkali test of grade 3 or higher according to the JIS L-0848-A Method and having a surface color shade of 20 or less in terms of L value determined by spectro-colorimetry.

The dyed mixed fiber article containing polyurethane fiber can be prepared by dyeing a mixed fiber article composed of disperse dyeable fiber and polyurethane fiber, such as a co-knitted fabric, either in a dye bath in the presence of polyvalent metallic compound and tannic acid or after the co-knitted fabric has been treated in a bath containing polyvalent metallic compound and tannic acid.

10 Claims, No Drawings

BLENDED DYED PRODUCT OF FIBER DYEABLE WITH DISPERSE DYE AND POLYURETHANE FIBER AND DYEING METHOD THEREFOR

TECHNICAL FIELD

The present invention relates to a dyed mixed fiber article composed of fiber dyeable with disperse dye (hereinafter referred to as "disperse dyeable fiber) and polyurethane fiber, and a method for fast-dyeing the mixed fiber article with disperse dye, more specifically to a dyed mixed fiber article composed of disperse dyeable fiber and polyurethane fiber, which is excellent in color value and color fastness, and a method for fast-dyeing the mixed fiber article.

BACKGROUND ART

When a mixed fiber fabric composed of a disperse dyeable fiber, typically polyethylene terephthalate fiber, and a polyurethane fiber is dyed with disperse dye, there is a problem in that since the disperse dye is excessively adsorbed in the polyurethane fiber, the color fastness of the dyed mixed fiber fabric is significantly lowered. To solve this problem, it is necessary to remove the disperse dye excessively adsorbed in the polyurethane fiber by reduction clearing of the dyed fabric.

Since the disperse dye excessively adsorbed in the polyurethane fiber in the mixed fiber article is difficult to sufficiently remove therefrom by reduction clearing, however, it is impossible to obtain a dyed mixed fiber article satisfactory in color fastness. Particularly, a dyed mixed fiber fabric dyed with disperse dye is weak, in color fastness, to perspiration-alkali.

There has also been a problem in color fastness to dry cleaning of the dyed mixed fiber fabric. This is because a dry cleaning liquid becomes significantly dirty to reversely contaminate the white part of the fabric or other fibers. A cause of the contamination of the dry cleaning liquid is the disperse dye remaining in the polyurethane fiber, and the degree of contamination of the dry cleaning liquid is approximately proportional to the residual concentration of the disperse dye. For this reason, it is necessary to carry out reduction clearing of the dyed mixed fiber article dyed with disperse dye under severe conditions wherein the concentration of a reduction agent and an alkaline agent is higher than the ordinary level, for example, 10 g/l, and a treatment temperature is as high as 90° C. to intensify the rinsing conditions. In a mixed fiber article such as a covering yarn having a high covering degree of polyurethane fiber, however, even if the reduction clearing condition becomes severe, it is impossible to remove the disperse dye in the polyurethane fiber to a satisfactory extent, and the color value of the disperse dyeable fiber is lowered to aggravate the shade variation in every dyeing batch.

To obviate such a problem, there may be a case wherein dyes easily decomposable by the alkali reduction clearing are used, such as heterocyclic azo type, condensation type or diester type disperse dyes. This is problematic, however, because it is difficult to obtain all colors with such dyes and the price of the dye is high. Also, since spandex is excessively deeply dyed, no improvement is seen in the mismatching and unevenness of color shades. Under the existing circumstances now stands, deep dyed articles of clothings having a, sufficient color fastness have not been obtained especially in the outer wears and inner wears (under wear).

Also, for the purpose of suppressing the adsorption of dye in spandex, disperse dyeable fiber is initially dyed and then mixed with non-dyed spandex to result in a mixed fiber fabric having a high color fastness.

In Japanese Examined Patent Publication (Kokoku) No. 62-38479, a method for improving a color fastness, especially that to laundering, is proposed wherein a mixed fiber article containing elastomeric polyester filament is dyed with disperse dye and then treated with an aqueous solution of tannic acid and tartar emetic, although it is irrelevant to a mixed fiber article containing elastomeric polyurethane fiber. However, there is a problem in that, since a large amount of disperse dye remains in the elastomeric polyester filament itself, a dry cleaning liquid is significantly contaminated therewith when the mixed fiber article is subjected to a dry cleaning. Also, color fastness to perspiration does not reach a satisfactory level.

Accordingly, at present, there is no superior mixed fiber fabric which is high in color fastness, low in contamination of dry cleaning liquid. Since disperse dye is excessively adsorbed in the polyurethane fiber in the mixed fiber fabric composed of fiber dyeable with disperse dye and polyurethane fiber, the color value of the disperse dyeable fiber becomes, lower to result in a product with a poor appearance.

DISCLOSURE OF THE INVENTION

An object of the present invention is to provide a dyed mixed fiber article composed of disperse dyeable fiber and polyurethane fiber excellent in wet color fastness such as that to perspiration-alkali or to washing. Another object of the present invention is to provided a method for fast color dyeing a mixed fiber article composed of disperse dyeable fiber and polyurethane fiber with the disperse dye at a predetermined color density while suppressing the dyeing of the polyurethane fiber.

The present invention is a dyed mixed fiber article composed of disperse dyeable fiber and polyurethane fiber, having a color fastness to a perspiration-alkali of grade 3or higher according to JIS L-0848-A Method and a surface color depth of 20 or less in term of color value L.

Preferably, the dyed mixed fiber article composed of disperse dyeable fiber and polyurethane fiber further satisfies at least one of a color fastness to perspiration-alkali of grade 4 or higher according to JIS L-0848-A Method and a dry cleaning liquid contamination value of grade 3 or higher according to JIS L-0860-A Method.

If the dyed mixed fiber article according to the present invention has a perspiration-alkali of grade 4 or higher according to JIS L-0848-A Method, the disperse dyeable fiber forming the mixed fiber article is preferably dyed with heterocyclic azo type, condensation type or diester type disperse dyes.

A degree of color depth of the polyurethane fiber contained in the mixed fiber article is preferably 60 or less. Thus, it is possible to maintain a wet color fastness of grade 3 or higher even if the dyed fiber mixed article according to the present invention is a piece-dyed product dyed with disperse dye.

A ratio of the polyurethane fiber to the disperse dyeable fiber in the dyed mixed fiber article according to the present invention is generally 40% or less. The mixing ratio may be suitably selected in accordance with forms or uses of the mixed fiber article. The remaining component in the mixed fiber article, i.e., the disperse dyeable fiber, may be mixed with wool, cotton, silk, ramie, cuprammonium rayon, viscose rayon or others. In a composite article composed of disperse dye dyeable fiber and another fiber such as cellulose fiber which is not dyeable with disperse dye, two-bath dyeing may be adopted, wherein the method according to the present invention is applied when the disperse dyeable fiber is dyed, and then the cellulose fiber is dyed with a direct dye or a reactive dye.

Alternatively, a mixed fiber article may be initially dyed by the method according to the present invention, and then further dyed by one-bath dyeing or two-bath dyeing, whereby the dyed mixed fiber article excellent in color fastness according to the present invention is obtainable.

A mixed fiber article composed of disperse dyeable fiber and polyurethane fiber may of a yarn structure and a fabric structure.

Examples of the yarn structure include a so-called covering yarn in which a bare yarn of the polyurethane fiber (having a thickness of 10 to 500 dtex) is covered with the disperse dye dyeable fiber (single and double covering yarns), a twisted yarn, a core yarn, or an entangled yarn.

On the other hand, examples of the fabric structure include a knit fabric, a woven fabric, a non-woven fabric and a composite fabric thereof (such as a laminated fabric). Concretely, there is an on-machine mixed fiber fabric in which bare yarns or covering yarns of the polyurethane fiber are arranged in parallel or adjacent to yarns of the disperse dye dyeable fiber on a weaving or knitting machine (in a case of the bare yarns, while stretching the former twice to four times the original length during the knitting or weaving operation) to be mixed in one fabric.

The polyurethane fiber used in the present invention for producing a mixed fiber article may be suitably selected from a group of polyether type, polyurethane fiber composed of diol component of polyether diol such as polytetramethyleneglycol, diisocyanate component of aromatic diisocyanate such as 4,4'diphenylmethandiisocyanate, and diamine component such as ethylenediamine; and polyester type polyurethane fiber composed of diol component of polyester diol composed of polycaprolactone or polyester composed of adipic acid/1,6 hexanediol/neopentyl glycol, and a diisocyanate component of aromatic diisocyahate such as 4,4'diphenylmethane diisocyanate. If necessary, the polyurethane fiber may contains one kind or more of metallic oxide or metallic hydroxide such as magnesium oxide, zinc oxide, aluminum oxide, magnesium hydroxide, zinc hydroxide, aluminum hydroxide, or hydrotalcite type compounds as a chlorination water anti-deterioration agent, a content of which is preferably in a range between 0.1 and 6.0% by weight, together with another known stabilizing agent, ultraviolet absorbing agent of the like.

The polyurethane fiber may be suitably selected from a bright type having high luster and a semi-dull type having suppressed luster in accordance with the uses thereof.

In this regard, it should be noted that the object of the present invention would not be achievable by using elastomeric polyester ether fiber instead of the polyurethane fiber. As shown in Comparative Examples described later, when the polyester polyether elastomeric fiber was used instead of the polyether type polyurethane fiber and dyed in a dye bath containing tannic acid and polyvalent metallic compound, no effect is recognized for suppressing the adsorption of disperse dye into the polyester polyether elastomeric fiber, whereby the improvement in color fastness is not discernible.

The disperse dye dyeable fiber to be mixed with the polyurethane fiber in the present invention includes fibers of polyethylene terephthalate, polyoxyethylene benzoate, polybutylene terephthalate, polyttrimethylehe terephthalate, polyamide, polyacryl, polyvinyl alcohol, acetate or others, which are dyeable with disperse dye.

The single fiber thickness of the disperse dye dyeable fiber is preferably in a range from 0.1 to 6 dtex, more preferably 0.5 to 3 dtex, and a total thickness thereof is in a range from 10 to 340 detex, although it is not limited thereto. By using such a fiber, a fabric excellent in dyeability and touch is obtainable.

The disperse dye dyeable fiber may be either of a continuous filament shape or a short staple fiber shape, including those uniform or irregular in thickness in the lengthwise direction, the cross-sectional shape of which may be circular, triangular, polygonal, multi-lobal or indefinite, including an L-shape, a T-shape, a Y-shape, a W-shape, an octagonal lobal shape, a flat shape and a dog-bone shape. The fiber may be either solid or hollow. The fiber may be converted to a yarn form such as a spun yarn manufactured from a ring spinning frame or an open end spinning frame, a filament yarn having a single fiber thickness in a range from 0.1 to 6 dtex (including an ultra-fine, yarn), a soft or hard twisted yarn, a mixed fiber yarn, a false-twist textured yarn (including a draw-false twist textured yarn of POY) or an air jet textured yarn.

In this regard, the mixed fiber article referred to in the present invention may contain a natural fiber such as wool, cotton or silk, or an artificial fiber such as cuprammonium rayon, viscose rayon or polyamide through a fiber-mixing means, such as a mixed-spinning process (including a ciro-spun or a ciro-fil), an entanglement mixing process (wherein yarns having various shrinkages are mixed together), a mixed-twisting process, a composite false-twist process (including an elongation-difference-false-twist process) or a two-feed air jet texturing process.

In a mixed article wherein natural fiber, cellulose fiber or polyamide fiber is additionally mixed with the disperse dye dyeable fiber, a two-bath dyeing method is used wherein the method according to the present invention is applied when the disperse dye dyeable fiber is dyed with disperse dye, and thereafter, the natural fiber, cellulose fiber or polyamide fiber is dyed with dye usually used therefor. Alternatively, prior to dyeing the mixed fiber article, the method according to the present invention is preliminarily applied, then the additionally mixed cellulose fiber, or another, is dyed by a one-bath dyeing or a two-step one-bath dyeing method, resulting in the dyed mixed fiber article excellent in color fastness according to the present invention.

When the disperse dye dyeable fiber is polyester fiber, the polyester fiber may be a conventional one. However, if it is necessary to avoid the embrittlement of polyurethane fiber due to heat during the dyeing, which is particularly required in a product for an underwear or sportswear use, an easily-dyeable polyester fiber is preferably used.

The easily-dyeable polyester fiber is polyester fiber which exhibits a dye-adsorption degree of 80% or higher when dyed in a dye bath containing disperse dye C.I. Disperse Blue 56 (for example, Resoline Blue FBL (Distar Company; trade name)) of 3% omf, having a bath ratio of 50 and a pH of 6 (adjusted with acetic acid) and containing a dispersant (for example, Disper TL (Meise Kagakukogyo; trade name) of 1 g/l, at 100° C. for 120 minutes. The dye-absorption degree is represented by the following equation (1):

Dye-adsorption degree (%)=[dye adsorbed into fiber (weight)/dye added to dye bath (weight)]×100

The easily-dyeable polyester fiber includes polyethylene terephthalate homopolymer fiber spun at a speed of 4000 m/min or higher and heat-treated at a temperature in a range from 220° C. to 300° C. with dry heat or at a temperature in a range from 180° C. to 240° C. with wet heat, or spin-takeup fiber spun at a speed of 6200 m/min or higher. Instead of the above-mentioned polyethylene terephthalate fiber, an easily-dyeable copolymerized polyester fiber spun at a high speed, which is linear polymer having a repeated unit of ethylene terephthalate and containing a third component such as isophthalic acid, sodium sulfonic isophthalate, polyethylene glycol, adipic acid or another, may be used. The polyester fiber may contain a delustering agent, a stabilizing agent, an antistatic agent or the like usually added to synthetic fiber.

Another example of an easily-dyeable polyester fiber is polytrimethylene terephthalate fiber. This fiber is a polyester fiber having a main repeated unit of trimethylene terephthalate unit wherein the trimethylene terephthalate unit is contained approximately 50 mol % or more, preferably 70 mol % or more, more preferably 80 mol %, most preferably 90 mol % or more. Accordingly, a total amount of the third component; i.e., the other acidic and/or glycolic component; is approximately 50 mol % or less, preferably 30 mol % or less, more preferably 20 mol % or less, most preferably 10 mol % or less.

The polytrimethylene terephthalate fiber may be produced by either a method wherein, after an undrawn yarn has been obtained at a takeup speed of approximately 1500 m/min, it is drawn at a draw ratio in a range from 2 to 3.5 times, a spin-draw method, wherein a spinning process is directly combined with a drawing process, or a spin-takeup method, wherein a yarn spun from a spinning machine is directly taken up at a high speed of 5000 m/min or more. The trimethylene terephthalate fiber may contain a delustering agent such as titanium, a stabilizing agent such as phosphoric acid, an ultraviolet absorbent such as derivative of hydoxybenzophenon, a crystal nucleus agent such as talc, a lubricant such as aerozil, an antioxidant, a flame retardant, an antistatic agent, pigment, a fluorescent whitening agent, an infrared absorbing agent, an anti-foaming agent or others.

In this regard, polytrimethylene terephthalate is synthesized from terephthalic acid or a functional derivative thereof and trimethylene glycol or a functional derivative thereof in the presence of a catalyst and in a suitable reactive condition. During this synthesizing process, one kind or more suitable third components are added to obtain copolymerized polyester. After a polyester other than polymethylene terephthalate, such as polyethylene terephthalate, or nylon has been synthesized separately from polytrimethylene terephthalate, they are blended with each other or compositely spun (to obtain a sheath-core type yarn or a side-by-side type yarn). The third component to be added thereto includes aliphatic dicarbonic acid (oxalic acid, adipic acid or the like), cycloaliphatic dicarbonic acid (cyclohexane dicarbonic acid or the like), aromatic dicarbonic acid (isophthalic acid, sodium sulfoisophthalic acid or the like), aliphatic glycol, (ethylene glycol, tetramethylene glycol, 1,2-propylene glycol, tetramethylene glycol or the like), cycloaliphatic glycol (cyclohexane dimethanol or the like), aliphatic glycol containing aromatic group (1,4-bis(β-hydoxyethoxy) benzene or the like), polyether glycol (polyethylene glycol, polypropylene glycol or the like), aliphatic oxycarbonic acid (ω-oxycapronic acid or the like) or aromatic oxycarbonic acid (P-oxybenzoic acid or the like). Also, compounds having one or three or more ester-forming functional groups (benzoic acid, glycerin or the like) may be used provided the polymer is maintained substantially in a linear range.

The dyed mixed fiber article according to the present invention includes all of fiber articles composed of the above-mentioned disperse dyeable fiber and polyurethane fiber mixed with each other through the above-mentioned mixing means, provided they have a predetermined color fastness.

That is, the dyed mixed fiber article of the present invention composed of disperse dye dyeable fiber and polyurethane fiber, having a color fastness to perspiration alkali of grade 3 or higher according to JIS L-0848-A Method and having a surface color density of 20 or less in term of color value L, can be obtained by dyeing a mixed fiber article composed of non-dyed disperse dye dyeable fiber and polyurethane fiber with disperse dye.

A dyed mixed fiber article of a desired color is obtainable by mixing a disperse dye dyeable fiber dyed in one color or a group thereof, each dyed in a different color and mixed with the other, is mixed with polyurethane fiber to result in the desired dyed mixed fiber article. Since the mixed fiber article is not dyed with disperse dye according to this method for preparing the dyed mixed fiber article, the urethane fiber in the mixed fiber article is not dyed or contaminated with disperse dye, whereby it is possible to easily prepare the dyed mixed fiber article having a color fastness to a perspiration-alkali solution of grade 3 or higher according to JIS L-0848-A Method. However, when the mixed fiber fabric is widely used in a field of outer wear, underwear or sportswear, wherein various colors are desired, this is disadvantageous in production cost. Also, there is a problem of "grinning" wherein a white rubbery elastomeric fiber is visible in the fabric to degrade the same. On such a point of view, it is preferable to apply the dyeing method according to the present invention to a non-dyed mixed fiber article to obtain a dyed mixed fiber article.

To obtain a dyed mixed fiber article of the present invention by dyeing a non-dyed mixed fiber article with disperse dye, it is necessary to adopt a special method for preventing the polyurethane fiber in the mixed fiber article from being dyed with disperse dye.

The inventors of the present invention have found that, if the non-dyed mixed fiber article is treated with a polyvalent metallic compound and tannic acid prior to being dyed, or dyed in a dye bath containing a polyvalent metallic compound and tannic acid, the dyed mixed fiber article composed of disperse dyeable fiber and polyurethane fiber excellent in color value and color fastness is obtainable because the adsorption of disperse dye into the polyurethane fiber in the mixed fiber article is significantly suppressed, while the disperse dyeable fiber is selectively dyed with the disperse dye.

As described above, in the non-dyed mixed fiber article composed of disperse dyeable fiber and polyurethane fiber, the adsorption of disperse dye into the polyurethane fiber can be significantly suppressed during the dyeing with disperse dye, and the disperse dye adsorbed into the polyurethane fiber is easily removable therefrom during the reduction clearing after the dyeing. Conveniently, this function is exhibited irrespective of kinds of color value chemical structure of disperse dye widely used in practical dyeing.

Accordingly, the dyeing method according to the present invention allows the use of benzolic azo type disperse dye to obtain the fast color dyed article, which is inexpensive in cost, rich in color variation, convenient in use and capable of deep shade dyeing. The function of suppressing the adsorption of disperse dye into the polyurethane fiber is also exhibited in heterocyclic azo type, condensation type and diester type disperse dyes which are liable to be desorbed during the reduction-clearing process.

According to the dyeing method of the present invention, since the adsorption of disperse dye into polyurethane fiber can be significantly reduced, irrespective of structural types of the disperse dye, the removal of disperse dye adsorbed in the polyurethane fiber can be easily done during the reduction clearing process, which solves the problem of color fastness relating to the contamination of polyurethane fiber during the reduction clearing process.

According to the dyeing method of the present invention, the dyed mixed fiber article having a color fastness to perspiration-alkali and the contamination of dry cleaning liquid of grade 3or higher is obtainable even by using not only the conventional benzolic azo type disperse dye but also another type thereof. In addition, when disperse dye of a type easily hydrolyzed with alkali, such as heterocyclic azo type, condensation type or diester type disperse dye is used, the color fastness to a perspiration-alkali solution and the contamination of dry cleaning liquid are further improved to grade 4 or higher.

According to the present invention, it is possible to select a dye from a wider dye spectrum including azo type disperse dye, heterocyclic azo type, condensation type or diester type disperse dye for realizing a desired color fastness of the resultant dyed article.

While antimony type compound is preferably used as polyvalent metallic compound, another type, such as tin type, aluminum type, zinc type, barium type or bismuth type, each of which may be used alone or combined with others, maybe used. As the antimony type compound, ammonium tartrate, sodium antimonyl tartrate and potassium antimonyl tartrate is preferable. Of them, sodium antimonyl tartrate is most preferably used.

The amount of polyvalent metallic compound used is preferably in a range from 0.01 to 1.5% omf, more preferably from 0.02 to 0.5% omf. If the amount is less than the lower limit, the object of the present invention may not be achieved, while even if it exceeds the upper limit, further improvement is not expectable.

The tannic acid is that obtained from Japanese gall or gall, and the amount thereof is preferably in a range of 0.1 to 10% omf, more preferably from 0.2 to 5% omf as a product concentration. If the amount is less than the lower limit, the object of the present invention may not be achieved, while even if it exceeds the upper limit, further improvement is not expectable but is uneconomical in cost.

A ratio in amount between the polyvalent compound and the tannic acid is in a range from 1:1 to 1:40, preferably from 1:3 to 1:20, more preferably from 1:3 to 1:10.

In the above-mentioned pretreatment prior to dyeing, the mixed fiber article is preferably immersed in aqueous solution containing polyvalent metallic compound and tannic acid, wherein a treatment temperature is preferably, in a range from 40 to 130° C., more preferably from 60 to 100° C. and a treatment time is preferably in a range from 10 to 40 minutes. At this time, pH of the treatment solution is preferably adjusted to 3 through 5 with a pH adjuster.

The mixed fiber article thus pretreated is dyed with disperse dye under the conventional dyeing condition usually applied to polyester fiber or others. That is, a dye solution containing disperse dye, a level dyeing agent, a pH adjuster or others is used as a dye bath, and the dyeing operation is carried out at a dyeing temperature suitable for disperse dyeable fiber, for example, in a range from 100 to 135° C. preferably from 100 to 130° C. for a period in a range from 20 to 40 minutes.

The disperse dye may be one kind or a blend of several kinds so that desired color depth of achromatic or chromatic color is obtainable.

Disperse dye generally includes benzolic azo type disperse dye such as monoazo, disazo or naphthalene azo type disperse dye wherein a basic structure is 4-nitro-4'-aminoazobenzene, and nitro group, halogen atom or cyano group is introduced into positions 2 and 2, 6 of diazo component, and alkyl group, alcoxy group, halogen atom or acylamino group is introduced into positions 2' or 2', 5' of a coupling component, and amino group of position 4' is substituted with alkyl, hydroxyalkyl, alcoxyalkyl, cyanoalkyl, aryl or aralkyl group, which may be equally applied to the present invention. Other examples of the disperse dye are a heterocyclic azo type disperse dye in which heterocyclic compound is used in diazo component or coupling component, such as thiazole azo, benzothiazole azo, quinoline azo, pyridone azo, imidazole azo or thiophene azo type disperse dye; a condensation type disperse dye including quinoline type disperse dye such as C.I. Disperse Yellow-54, C.I. Disperse Yellow-64, a coumarin type disperse dye such as C.I. Disperse Yellow-82, anaminoketone type disperse dye such as C.I. Disperse Yellow-58, a benzodifuranon type disperse dye such as C.I. Disperse Red 356 or C.I. Disperse Red 367; and a diester type disperse dye having diester group in the chemical structure, such as C.I. Disperse Red 278.

The dyeing method in which polyvalent metallic compound and tannic acid are dissolved in an aqueous dye solution to form a dye bath is carried out under the conventional condition for dyeing polyester fiber, for example, at a temperature in a range from 100 to 135° C., preferably from 100 to 130° C.

The dyeing period is preferably in a range from 20 to 40 minutes in view of the embrittlement of polyurethane fiber and the production cost. The pH of the dye solution is preferably adjusted to 4 to 5 by adding a pH adjuster, such as acetic acid, thereto.

As a level dyeing agent used in this method, alkyl naphthalene type such as β-naphthalene sulfonic acid formaldehyde condensate and polyalkyleneoxide addition product of polyvalent alcoholic fatty ester or sulfated product thereof are preferably used.

In the present invention, after the completion of the dyeing operation of the mixed fiber article, the reduction clearing is carried out under the existence of hot alkaline agent.

The treatment with a co-existence bath of tannic acid and polyvalent metallic compound used in the present invention is aimed at suppressing the adsorption of disperse dye into polyurethane fiber so that a larger amount of disperse dye is given to the disperse dyeable fiber. According to the present invention, not only the adsorption of disperse dye into polyurethane fiber is significantly suppressed, but also the disperse dye diffused into the polyurethane fiber is quickly decomposed by the reduction clearing carried out after the dyeing, and substantially completely removed from the polyurethane fiber. Thus, the degree of pigmentation of the polyurethane fiber in the dyed mixed fiber article composed of disperse dyeable fiber and polyurethane fiber is lowered to 60 or less which enhances the wet color fastness of dyed article and significantly reduces the contamination of dry cleaning liquid.

Piece dyeing of the mixed fiber article of the present invention enhances the adsorption of disperse dye into the disperse dye dyeable fiber to reduce the waste dye and prepare the dyed mixed fiber article excellent in color value and appearance. Further, the color variation in every dye batch is suppressed to improve the operating efficiency of the dyeing machine. Since only a small amount of disperse dye is adsorbed into the polyurethane fiber, it is sufficient that the concentration of a reducing agent and an alkaline agent is in a range from 1 to 2 g/l, and it is unnecessary to rise a treatment temperature, whereby there is no generation of color variation in every reduction clearing batch.

When the mixed fiber article composed of disperse, dye dyeable fiber and polyurethane fiber is a fabric, it is preferably dyed after being knitted or woven and subjected to a relaxation scouring. In such a case, the scouring is preferably carried out at a temperature in a range from 60 to 98° C. while relaxing the fabric as much as possible, in view of facilitating the stretch recovery of the fabric. When a shape set is necessary prior to dyeing, the fabric is preferably preset at a temperature in a range from 170 to 200° C. by dry heat, and after the reduction clearing, finished in a usual manner, after which the fabric is finally set at a temperature lower than the preset temperature by 10° C. or more.

The predyeing treatment with the co-existence bath of tannic acid and polyvalent metallic compound is very effective when the mixed fiber article is composed of disperse dyeable fiber and natural fiber such as wool, cotton or silk, cuprammonium rayon, viscose rayon, or polyamide fiber, or when the article is piece-dyed or product-dyed. The effect for suppressing the dye adsorption into the polyurethane fiber during the dyeing of the pretreated article with disperse dye is inferior to that when tannic acid and polyvalent metallic compound co-exist with each other in the dye bath of disperse dye, although the color fastness of the dyed mixed fiber article is sufficient.

BEST MODE FOR CARRYING OUT THE INVENTION

The present invention will be described in more detail below, with reference to the preferred embodiments, but should not limited thereto.

Characteristic values and estimated values in examples and comparative examples are obtained according to the following measurements and estimation methods:

(1) Color Fastness to Perspiration-alkali

A color fastness to perspiration-alkali was estimated in accordance with JIS L-0848-A Method by using an alkaline artificial perspiration solution. The color deterioration of a test piece and a degree of contamination of the attached white fabric piece were compared with those of gray scales for determining the color deterioration and contamination, respectively.

(2) Color Fastness to Washing

The estimation was carried out on a dyed mixed fiber article in accordance with JIS L-0844A-2 Method. As a detergent, Attack (available from Kao K. K.; trade name) was used at 1 g/l. The color deterioration of a test piece and a degree of contamination of the attached white fabric piece were compared with those of gray scales for determining the color deterioration and contamination, respectively.

(3) Staining of Dry Cleaning Liquid

A dry cleaning test was carried out on a mixed fiber article in accordance with JIS L-0860. A dry cleaning liquid and a stained liquid after the dry cleaning test were taken into porcelain containers (20 mm×40 mm×10 mm), respectively, and compared with gray scales for the stained liquid to estimate a degree of dye desorption from grade 1 (most desorption) to grade 5 (least desorption).

(4) Degree of Color Depth of Polyurethane Fiber in Dyed Mixed Fiber Article

A degree of color depth was estimated on polyurethane fiber withdrawn from a fabric in accordance with JIS Z-8730 by using a spectro-colorimeter (available from Kollmorgen Company; Macbeth MS-2020Type). The degree of color depth D is an indication of a difference in color of polyurethane fiber between before the dyeing and after the dyeing and finishing of the fabric, and determined in a Lab color system by the following equation:

$$D=(\Delta L^2+\Delta a^2+\Delta b^2)^{1/2}$$

wherein ΔL is a value obtained by subtracting a measured value of lightness index L of polyurethane fiber after the dyeing and finishing from that before the dyeing, and, similarly, Δa and Δb are differences, respectively, in measured values of chromaticisty index between the, two states of the polyurethane fiber.

(5) Measurement of Color Value L of Dyed Article

A color density on the surface of the dyed fabric is measured by using a spectro-colorimeter (available from Kollmorgen Company; Macbeth MS-2020 Type) to determine value L in a Lab color system. The lower the value L, the higher the color depth. In this regard, if the value L is 20 or less, the article is dyed in deep color.

(6) Measurement of K/S Value,

The K/S value was determined by measuring a spectral reflectance (due to a light exhibiting the maximum surf ace reflectance) with a surface spectro-colorimeter ( available from Kollmorgen Company; Macbeth HS-200 Type) and substituting the same into the following equation:

$$K/S=(1-R)^2/2R$$

wherein R is a reflectance ($0<R\leqq 1$), K is a Kubelka-Munk absorption, factor and S is a scattering factor. The larger the K/S value, the better the color value.

(7) Measurement of ηsp/c

ηsp/c was determined by dissolving polymer in o-chlorophenol (solvent) at 90° C. at a ratio of 1 g/dl, transferring the resultant solution to an Ostwald viscometer in which the measurement is carried out at 35° C., and substituting the measured values into the following equation:

$$\eta sp/c\ (T/T_0)/C$$

wherein T is a time necessary for dropping the sample solution (sec), $T_0$ is a time necessary for dropping the solvent (sec), and C is a concentration of the solution (g/dl).

(8) Measurement of Fiber Thickness of Polyurethane Fiber and Polyester Ether Elastomeric Fiber The polyurethane fiber or the polyester ether elastomeric fiber is freely shrunk while left linearly in a tensionless and chargeless state at a temperature of 20° C. and a relative humidity of 65%. Thereafter, ten test pieces of 1000 mm long are weighed to obtain a weight of a 10,000 mm length fiber which value corresponds to a thickness represented by dtex.

EXAMPLE 1

Polyethylene terephthalate having ηsp/c of 0.65 and containing $TiO_2$ of 0.4% was melt spun at a spinning temperature of 290° C., and was taken up at a winding speed of 7000 m/mi by a spin takeup system, resulting in a yarn of 56 dtex/24f. This yarn was the above-mentioned easily-dyeable polyester fiber (dye exhaustion ratio is 89%).

A six-course satin net knit fabric (having a course density of 171 loops/2.54 cm and a wale density of 41 loops/2.54 cm) was prepared under the usual knitting condition from the above-mentioned polyester fiber and polyether type polyurethane fiber (available from Asahi. Kasei Kogyo K. K.; trade name Loica SC). A mixing ratio of the polyurethane fiber in the mixed fiber knit fabric was 21%.

The mixed fiber knit fabric was soured and relaxed at 90° C. and thereafter preset in a width-widening state at 180° C. Then, the fabric was dyed under the following condition.

Dyeing Condition:

dye: C.I. Disperse Blue 167 (benzolic azo type disperse dye) 7% omf level dyeing agent: Nikka Sunsalt RM-340 (available from Nikka Kagaku Kogyo K.K.): 0.5 g/l acetic acid: 0.5 cc/l sodium acetate: 1 g/l bath ratio 1:20 dyeing temperature and time: 120° C., 30 minutes

In this regard, in the dye batch, tannic acid (tannic acid extract available from Dainippon Seiyaku K. K.; pure amount of 50%) and sodium antimonyl tartrate were added at various concentrations.

After the completion of dyeing operation, the residual dye solution was discharged from the dyeing machine, and instead, water was poured into the dyeing machine and heated to 70° C., into which then was added the following agents to prepare the reduction clearing bath of the following concentration, in which was carried out the reduction clearing of the dyed article at 70° C. for 10 minutes.

thiourea dioxide: 2 g/l.

caustic soda: 1 g/l

Sunmol RC-700 (nonion detergent; available from Nikka Kagaku Kogyo K. K.): 0.5 g/l bath ratio: 1:30

After the reduction clearing, the residual solution was discharged, and the dyed article was sufficiently rinsed with warm water and cold water. Thereafter, the dyed article was finished by setting with dry heat at 160° C. for 30 seconds.

Measured results of the finished dyed article on color fastness to perspiration-alkali, to washing and the contamination of dry cleaning liquid are listed in Table 1. No color was recognized on the polyurethane fiber composing the polyurethane-mixed dyed article.

COMPARATIVE EXAMPLE 1

The same dyeing and finishing process as in Example 1 was repeated while using the same mixed fiber knit fabric containing polyurethane fiber, except that the addition of tannic acid and/or sodium antimonyl tartrate is eliminated. Properties and color fastness of the resultant dyed and finished knit fabric are shown in Table 1. As apparent from Table 1, the dyed article of Example 1 according to the present invention has a high color value (particularly the L value is as low as less than 20), a very high color fastness to perspiration-alkali of grade 3 or higher, a very high color fastness to washing of grade 4 or higher , and contamination of dry cleaning liquid of grade 3 or more. Contrarily, the dyed article obtained from Comparative example 1 has a high-degree of pigmentation of 60 or more, and is inferior to the dyed article obtained from Example 1 in any of the color fastness to perspiration-alkali, laundering and the staining of a dry cleaning liquid.

COMPARATIVE EXAMPLE 2

Polyester ether elastomeric fiber (available from Teijin Ltd.; trade name Lexse) having a fiber thickness of 156 dtex was used instead of the polyether type polyurethane fiber in Example 1. A six-course satin net knit fabric (having a course density of 177 loops/2.54 cm and a wale density of 43 loops/2.54 cm) was prepared under the usual knitting condition, wherein a mixing ratio of the polyurethane fiber in the mixed fiber knit fabric was 16%, and dyed and finished in the same manner as in Example 1. Properties and color fastness of the resultant dyed and finished knit fabric are shown in Table 1. As apparent from Table 1, the dyed article obtained from Comparative example 2 has a high degree of pigmentation of 60 or more, and is inferior to the dyed article obtained from Example 1 in any of the color fastness to perspiration-alkali, washing and the staining of dry cleaning liquid.

TABLE 1

Results of dyed mixed fiber article (Example 1, Comparative examples 1 and 2)

| | Concentration of tannic acid (% mof) | Concentration of sodium antimony tartrate (% mof) | Color fastness to perspiration-alkali: Change in color shade | Color fastness to perspiration-alkali: Staining | Color fastness to washing: Change in color shade | Color fastness to washing: Staining | Staining of dry cleaning liquid | Color value (K/S value) | Color value (L value) | Degree of color depth of polyurethane fiber (D) |
|---|---|---|---|---|---|---|---|---|---|---|
| Comparative example 1 | 0 | 0 | 5 | 2 | 5 | 3 | 2 | 26.4 | 19.8 | 67.2 |
| | 3 | 0 | 5 | 2 | 5 | 3 | 2 | 26.3 | 19.8 | 67.6 |
| | 0 | 0.3 | 5 | 2 | 5 | 3 | 2 | 26.4 | 19.8 | 66.9 |
| Example 1 | 0.1 | 0.01 | 5 | 3–4 | 5 | 4 | 3 | 27.0 | 19.2 | 35.2 |
| | 0.5 | 0.05 | 5 | 3–4 | 5 | 4 | 3 | 27.5 | 19.0 | 25.1 |
| | 1 | 0.1 | 5 | 5 | 5 | 5 | 4~5 | 29.8 | 18.5 | 2.8 |
| | 5 | 0.5 | 5 | 5 | 5 | 5 | 4~5 | 29.8 | 18.5 | 2.5 |
| | 10 | 1.5 | 5 | 5 | 5 | 5 | 4~5 | 29.8 | 18.5 | 1.5 |
| Comparative example 2 | 0.1 | 0.01 | 5 | 2 | 5 | 3 | 2 | 27.1 | 19.7 | 66.6 |
| | 0.5 | 0.05 | 5 | 2 | 5 | 3 | 2 | 27.1 | 19.7 | 66.8 |
| | 1 | 0.1 | 5 | 2 | 5 | 3 | 2 | 27.0 | 19.7 | 66.4 |
| | 5 | 0.5 | 5 | 2 | 5 | 3 | 2 | 27.1 | 19.7 | 67.1 |
| | 10 | 1.5 | 5 | 2 | 5 | 3 | 2 | 26.9 | 19.6 | 67.5 |

EXAMPLE 2

The knit fabric containing polyurethane fiber prepared in Example 1 was scoured and relaxed at 90° C. and preset at 180° C. Thereafter, prior to being dyed, it was immersed in an aqueous solution containing tannic acid and sodium antimonyl tartrate of the concentration shown in Table 1 and acetic acid of 0.5 cc/l and treated at 80° C. for 20 minutes.

The mixed fiber knit fabric subjected to the tannic bath treatment was dyed under the following condition, respectively. After being dyed, the dyed fabrics was subjected to the reduction clearing treatment in the same condition as in Example 1, and finished.

Dyeing Condition:

dye: C.I. Disperse Blue 167 (benzolic azo type disperse dye) 7% omf level dyeing agent: Nikka Sunsalt RM-340 (available from Nikka Kagaku Kogyo K.K.): 0.5 g/l acetic acid: 0.5 cc /l sodium acetate: 1 g/l bath ratio: 1:20 dyeing temperature and time: 120° C., 30 minutes

Measurement results of the finished dyed article on color fastness to perspiration-alkali, washing and the contamination of dry cleaning liquid are listed in Table 2. No color due to dye was recognized on the polyurethane fiber in the dyed fabric.

COMPARATIVE EXAMPLE 3

Prior to being dyed, the knit fabric prepared in Example 2 was treated or not treated with tannic acid or sodium antimonyl tartrate as shown in Table 2 instead of the pretreatment of Example 2, and then dyed and finished in the same manner as in Example 2. Estimation results of the dyed fabric are shown in Table 2. As apparent from Table 2, the dyed fabric of Example 2 has a high color value represented by the L value as low as less than 20, a very high color fastness to perspiration-alkali of grade 3 or higher, a very high color fastness to washing of grade 4 or higher, and a contamination of dry cleaning liquid of grade 3 or more.

Contrarily, the dyed fabric obtained from Comparative example 3 has a high degree of pigmentation of 60or more, and is inferior to the dyed fabric obtained from Example 2 in any of the color fastness to perspiration-alkali, washing and the staining of dry cleaning liquid.

EXAMPLE 3

A six-course satin net knit fabric similar to that prepared in Example 1 was prepared from polyethylene terephthalate fiber of 56 dtex/36 f having a W-shaped, cross-section (available from Asahi Kasei Kogyo K. K.; trade name Technofine) and polyether type polyurethane fiber of 311 dtex (available from Asahi Kasei Kogyo K. K.; trade name Loica SC), which was then relaxed and preset in the same manner as in Example 1. Thereafter, the mixed fiber fabric was dyed under the following condition:

Dyeing Condition:

dye: .C.I. Disperse Blue 167 (benzolic azo type disperse dye) 7% omf level dyeing agent: Nikka Sunsalt RM-340: 0.5 g/l acetic acid: 0.5 cc/l sodium acetate: 1 g/l tannic acid: 3% omf sodium antimonyl tartrate: 0.3% omf bath ratio: 1:20 dyeing temperature and time: 125° C., 30 minutes

The dyed fabric was subjected to the reduction clearing treatment in the same manner as in Example 1, and set and finished with dry heat at 160° C. for 30 seconds.

Measured results of the dyed fabric on dyeing characteristic, color fastness to perspiration-alkali, washing and the contamination of dry cleaning liquid are listed in Table 3. No color was recognized on the polyurethane fiber in the dyed fabric.

COMPARATIVE EXAMPLE 4

The same process as in Example 1 was repeated, except that tannic acid and sodium antimonyl tartrate are not used, to obtain the dyed knit fabric. Measured results thereof are shown in Table 3.

As apparent from Table 3, the dyed fabric of Example 3 has a high color value, a very high color fastness to perspiration-alkali of grade 3 or higher, a very high color fastness to washing, and little contamination of the dry cleaning liquid. Contrarily, the dyed mixed fiber fabric obtained from comparative example 4 has a high degree of pigmentation of polyether type polyurethane fiber, and is inferior to the dyed mixed fiber fabric obtained from Example 3 in either of the color fastness to perspiration-alkali, washing and the staining of dry cleaning liquid.

TABLE 2

Results of dyed mixed fiber article (Example 2, Comparative example 3)

| | Concentration of tannic acid (% mof) | Concentration of sodium antimony tartrate (% mof) | Color fastness to perspiration-alkali: Change in color shade | Color fastness to perspiration-alkali: Staining | Color fastness to washing: Change in color shade | Color fastness to washing: Staining | Staining of dry cleaning liquid | Color value (K/S value) | Color value (L value) | Degree of color depth of polyurethane fiber (D) |
|---|---|---|---|---|---|---|---|---|---|---|
| Comparative example 3 | 0 | 0 | 5 | 2 | 5 | 3 | 2 | 26.4 | 19.8 | 63.5 |
| | 3 | 0 | 5 | 2 | 5 | 3 | 2 | 26.4 | 19.8 | 63.8 |
| | 0 | 0.3 | 5 | 2 | 5 | 3 | 2 | 26.4 | 19.8 | 63.1 |
| Example 2 | 0.1 | 0.01 | 5 | 3–4 | 5 | 4 | 3 | 26.8 | 19.3 | 46.3 |
| | 0.5 | 0.05 | 5 | 3–4 | 5 | 4 | 3 | 27.0 | 19.3 | 30.5 |
| | 1 | 0.1 | 5 | 5 | 5 | 5 | 4 | 28.1 | 19.0 | 18.8 |
| | 3 | 0.3 | 5 | 5 | 5 | 5 | 4 | 28.1 | 19.0 | 13.8 |
| | 5 | 0.5 | 5 | 5 | 5 | 5 | 4 | 28.1 | 19.0 | 13.8 |

TABLE 3

Results of dyed mixed fiber article (Example 3, Comparative example 4)

| | Co-existence dyeing of tannic acid and antimony salt of tartaric acid | Color fastness to perspiration-alkali | | Color fastness to washing | | Staining of dry cleaning liquid | Color value (K/S value) | Color value (L value) | Degree of color depth of polyurethane fiber (D) |
|---|---|---|---|---|---|---|---|---|---|
| | | Change in color shade | Staining | Change in color shade | Staining | | | | |
| Comparative example 4 | no | 5 | 2 | 5 | 3 | 2 | 26.2 | 19.9 | 65.5 |
| Example 3 | yes | 5 | 5 | 5 | 5 | 4~5 | 30.9 | 18.3 | 2.5 |

EXAMPLE 4

A six-course satin net knit fabric similar to that prepared in Example 1 was knitted from modified polyethylene terephthalate copolymerized with sodium sulfonic is ophthalate of 56 dtex/36 f (available from Asahi Kasei Kogyo K. K.; trade name CVT) and polyether type polyurethane fiber (available from Asahi Kasei Kogyo K. K.; trade name Loica SC). Then, the mixed fiber knit fabric was soured and relaxed at 90° C. and thereafter preset in a width-widening state at 175° C. Then, the fabric was dyed under the following condition.

Dyeing Condition:

dye: C.I.,Disperse Blue 16.7 (benzolic azo type disperse dye) 7% omf level dyeing agent: Nikka Sunsalt RM-340: 0.5 g/l acetic acid: 0.5 cc/l sodium acetate: 1 g/l tannic acid: 3% omf sodium antimonyl tartrate: 0.3% omf bath ratio: 1:20 dyeing temperature and time: 110° C., 30 minutes

After the completion of dyeing operation, the reduction clearing of the dyed article was carried out under the following condition. The rinsed fabric was finished by the setting with dry heat in the same manner as in Example 1.

bath ratio: 1:30 treatment temperature and time: 70° C., 10 minutes

Measured results of the dyed article on color fastness to perspiration-alkali, washing and the contamination of dry cleaning liquid are listed in Table 4. No color was recognized on the polyether type polyurethane fiber in the dyed article.

COMPARATIVE EXAMPLE 5

The same dyeing and finishing process as in Example 4 was repeated while using the same mixed fiber knit fabric, except that the use of tannic acid and sodium antimonyl tartrate is eliminated. Measured results are shown in Table 4, As apparent from Table 4, the dyed mixed fiber article dyed according to the method of Example 4 is a good quality product having a high color value, a very high color fastness to perspiration-alkaline solution, a very high color fastness to washing, and little staining of dry cleaning liquid. Contrarily, the dyed article obtained from Comparative example 5 has a high degree of pigmentation of polyether, type polyurethane fiber, and is inferior to the dyed article obtained from Example 1 in either of the color fastness to perspiration-alkaline solution, washing and the staining of dry cleaning liquid.

TABLE 4

Results of dyed mixed fiber article (Example 4, Comparative example 5)

| | Co-existence dyeing of tannic acid and antimony salt of tartaric acid | Color fastness to perspiration-alkali | | Color fastness to washing | | Staining of dry cleaning liquid | Color value (K/S value) | Color value (L value) | Degree of color depth of polyurethane fiber (D) |
|---|---|---|---|---|---|---|---|---|---|
| | | Change in color shade | Staining | Change in color shade | Staining | | | | |
| Comparative example 5 | no | 5 | 2 | 5 | 3 | 2 | 26.0 | 20.0 | 62.5 |
| Example 4 | yes | 5 | 5 | 5 | 5 | 4~5 | 29.4 | 18.7 | 2.3 |

Condition of Reduction Clearing thiourea dioxide: 1 g/l caustic soda: 0.5 g/l

Sunmol RC-700: 0.5 g/l

EXAMPLE 5

Polytrimethylene terephthalate having ηsp/c of 0.8 was melt-spun at a spinning temperature of 265° C., and was taken up at a winding speed of 1200 m/mi, resulting in an undrawn yarn which was then drawn at a hot roll temperature of 60° C., a hot plate temperature of 140° C., a draw ratio of 3 times and a drawing speed of 800 m/min to be a drawn yarn of 56 dtex/24 f. The tensile strength at break, the elongation at break, elastic modulus and elastic recovery at 10% elongation of the drawn yarn were 3.2 cN/dtex, 45%, 28.4 cN/dtex and 96%, respectively. In this regard, the elastic recovery at 10% elongation of this yarn is obtained in the following manner. A test piece is applied with an initial load of 0.011 g/dtex and stretched at a constant rate of 20%/min. When the elongation reaches 10%, the test piece is reversely contracted at the same rate to produce a stress-strain curve, from which a residual elongation (L) is obtained as a point in a contraction curve at which the stress becomes equal to the initial load 0.011 g/dtex . The elastic recovery is calculated by the following equation:

Elastic Recovery at 10% Elongation (%)=(10−L)/10×100

A six-course satin net knit fabric (having a course density of 171 loops/2.54 cm and a wale density of 41 loops/2.54 cm) was prepared under the usual knitting condition from the above-mentioned polytrimethylene terephthalate fiber and polyether type polyurethane fiber (available from Asahi Kasei Kogyo K. K.; trade name Loica SC). A mixing ratio of the polyurethane fiber in the mixed fiber knit fabric was 21%.

The mixed fiber knit fabric was scoured and relaxed at 90° C. and thereafter preset in a width-widening state at 175° C. Then, the fabric was dyed under the following condition.

Dyeing Condition:

dye: C.I. Disperse Blue 167 (benzolic azo type disperse dye) 7% omf level dyeing agent: Nikka Sunsalt RM-340 (available from Nikka Kagaku Kogyo K.K.): 0.5 g/l acetic acid: 0.5 cc/l sodium acetate: 1 g/l bath ratio: 1:20 dyeing temperature and time: 110° C., 30 minutes

Reduction Clearing Condition:

thiourea dioxide: 2 g/l caustic soda: 1 g/l

Sunmol RC-700 (nonionic detergent; available from Nikka Kagaku Kogyo K.K.): 0.5 g/l bath ratio: 1:30

After the reduction clearing, the residual solution was discharged, and the dyed article was sufficiently rinsed with warm water and cold water. Thereafter, the dyed article was finished by the setting with dry heat at 160° C. for 30 seconds.

Presults of the finished dyed article on color fastness to perspiration-alkali, washing and the contamination of dry cleaning liquid are listed in Table 5. No color was recognized on the polyether type polyurethane fiber in the dyed article.

COMPARATIVE EXAMPLE 6

The same process as in Example 5 was repeated, except that the dyeing is carried out without the co-existence of tannic acid and sodium antimonyl tartrate or with one of them as shown in Table 5. Estimation results of the finished dyed article are shown in Table 5.

As apparent from Table 5, the dyed fabric of Example 5 has a high color value, a very high color fastness to perspiration-alkali solution of grade 3 or higher, a very high color fastness to washing, and little contamination of a dry cleaning liquid. Contrarily, the dyed mixed fiber fabric obtained from Comparative example 6 has a high degree of pigmentation of polyether type polyurethane fiber, and is inferior to the dyed mixed fiber fabric obtained from Example 5 in either of the color fastness to perspiration-alkali, laundering and the staining of dry cleaning liquid.

TABLE 5

Results of dyed mixed fiber article (Example 5, Comparative example 6)

| | Concentration of tannic acid (% mof) | Concentration of sodium antimony tartrate (% mof) | Color fastness to perspiration-alkali: Change in color shade | Color fastness to perspiration-alkali: Staining | Color fastness to washing: Change in color shade | Color fastness to washing: Staining | Staining of dry cleaning liquid | Color value (K/S value) | Color value (L value) | Degree of to color depth of polyurethane fiber (D) |
|---|---|---|---|---|---|---|---|---|---|---|
| Comparative example 6 | 0 | 0 | 5 | 2 | 5 | 3 | 2 | 26.8 | 19.7 | 66.3 |
| | 3 | 0 | 5 | 2 | 5 | 3 | 2 | 26.8 | 19.7 | 66.9 |
| | 0 | 0.3 | 5 | 2 | 5 | 3 | 2 | 26.8 | 19.7 | 66.0 |
| Example 5 | 0.1 | 0.01 | 5 | 3–4 | 5 | 4 | 3 | 27.6 | 19.2 | 30.9 |
| | 0.5 | 0.05 | 5 | 3–4 | 5 | 4 | 3 | 27.9 | 19.1 | 24.5 |
| | 1 | 0.1 | 5 | 5 | 5 | 5 | 4~5 | 30.1 | 18.6 | 2.7 |
| | 3 | 0.3 | 5 | 5 | 5 | 5 | 4~5 | 30.4 | 18.4 | 2.4 |
| | 5 | 0.5 | 5 | 5 | 5 | 5 | 4~5 | 30.4 | 18.4 | 2.4 |

In this regard, in the dye bath, tannic acid (tannic acid extract available from Dainippon Seiyaku K.K.) and sodium antimonyl tartrate were added at various concentrations.

After the completion of dyeing operation, the residual dye solution was discharged from the dyeing machine and, instead, water was poured into the dyeing machine and heated to 70° C., into which then was added the following agents to prepare the reduction clearing bath of the following concentration, in which was carried out the reduction clearing of the dyed article at 70° C. for 10 minutes.

EXAMPLE 6

The six-course satin net knit fabric prepared in Example 1 was relaxed and preset in the same manner as in Example 1, and thereafter, dyed with the following three dyes (1) to (3), respectively, under the following condition:

Dyeing Condition:

dye: (1) C.I. Disperse Black T-532 (diester type disperse dye) 14% omf (2) Dianix Blue HR-FS (heterocyclic azo type disperse dye) 10% omf (3) C.I. Disperse Red (condensation type disperse dye) 15% omf level dyeing agent: Nikka Sunsalt RM-340: 0.5 g/l acetic acid: 0.5 cc/l sodium acetate: 1 g/l tannic acid: 3% omf sodium acetate: 1 g/l sodium antimony tartrate: 0.3% omf bath ratio: 1:20 dyeing temperature and time: 120° C., 30 minutes

After the completion of dyeing, the reduction clearing was carried out in the same manner as in Example 1, and the dyed article was set and finished with dry heat at 160° C. for 30 seconds.

Measured results of the dyed fabric on dyeing characteristic, color fastness to perspiration, washing and the staining of dry cleaning liquid are listed in Table 6. No color was recognized on the polyurethane fiber in the dyed fabric.

COMPARATIVE EXAMPLE 7

The same process as in Example 6 was repeated, except that tannic acid and sodium antimonyl tartrate are not used, to obtain the dyed knit fabric. As apparent from Table 6, the dyed fabric of Example 7 has a high color value, a very high color fastness to perspiration-alkali of grade 3 or higher, a very high color fastness to washing, and little contamination of dry cleaning liquid. Contrarily, the dyed mixed fiber fabric obtained from Comparative example 7 is inferior to the dyed mixed fiber fabric obtained from Example 3 in either of the degree of pigmentation of polyether type polyurethane fiber, and color fastness to perspiration-alkali, washing and the staining of dry cleaning liquid.

EXAMPLE 7

The six-course satin net knit fabric prepared in Example 1 was dyed, after relaxation, and preset, as defined in Example 1, under the following condition. In this regard, polyvalent metallic compounds to be added to the respective dye bath are shown in Table 7.

Dyeing Condition:

dye: Dianix Navy Blue (200) (benzolic azo type disperse dye) 3% omf level dyeing agent: Nikka Sunsalt 8000 (available from Nikka Kagaku Kogyo K. K.; polyalkyleneoxide addition product of polyvalent aliphatic acid and sulfated product thereof): 1 g/l acetic acid: 0.5 cc/l sodium acetate: 1 g/l tannic acid: 1% omf polyvalent metallic compound: 0.08% omf bath ratio: 1:20 dyeing temperature and time: 120° C., 30 minutes

After the completion of dyeing, the reduction clearing was carried out as in Example 1, and the dyed article was set and finished with dry heat at 160° C. for 30 seconds.

Measured results of the dyed fabric on color fastness to perspiration, washing and the contamination of dry cleaning liquid are listed in Table 7. No color was recognized on the polyether type polyurethane fiber in the dyed fabric.

COMPARATIVE EXAMPLE 7

The same process as in Example 6 was repeated, except that the polyvalent metallic compounds shown in Table 7 are not used, to obtain the dyed knit fabric. Measured results of the finished knit fabric are shown in Table 7.

As apparent from Table 7, the dyed fabric of Example 7 is a good quality product excellent in color value, color fastness to perspiration-alkali and to washing and low in staining of a dry cleaning liquid in comparison with that obtained from Comparative example 8.

TABLE 6

Results of dyed mixed fiber article (Example 6, Comparative example 7)

| | | Co-existence dyeing of tannic acid and antimony salt of tartaric acid | Color fastness to perspiration-alkali | | Color fastness to washing | | Staining of dry cleaning liquid | Color value (L value) | Degree of to color depth of polyurethane fiber (D) |
|---|---|---|---|---|---|---|---|---|---|
| | | | Change in color shade | Staining | Change in color shade | Staining | | | |
| Comparative example 7 | ①Diester type disperse dye | no | 5 | 3 | 5 | 3~4 | 2~3 | 15.4 | 60.6 |
| | ②Heterocyclic azo type disperse dye | no | 5 | 3 | 5 | 3~4 | 2~3 | 23.4 | 60.2 |
| | ③Condensation type disperse dye | no | 5 | 3 | 5 | 3~4 | 2~3 | 24.6 | 60.3 |
| Example 6 | ①Diester type disperse dye | yes | 5 | 5 | 5 | 5 | 4~5 | 14.3 | 2.1 |
| | ②Heterocyclic azo type disperse dye | yes | 5 | 5 | 5 | 5 | 4~5 | 19.2 | 2.5 |
| | ③Condensation type disperse dye | yes | 5 | 5 | 5 | 5 | 4~5 | 19.9 | 2.3 |

TABLE 7

| | Results of dyed mixed fiber article (Example 7, Comparative example 8) | | | | | | | |
|---|---|---|---|---|---|---|---|---|
| | | Color fastness to perspiration-alkali | | Color fastness to washing | | | | Degree of color |
| | Polyvalent metallic compound | Change in color shade | Staining | Change in color shade | Staining | Staining of dry cleaning liquid | Color value (L value) | depth of polyurethane fiber (D) |
| Comparative example 8 | no | 5 | 2–3 | 5 | 3 | 2~3 | 20.2 | 62.4 |
| Example 7 | Tin chloride (II) | 5 | 5 | 5 | 5 | 4~5 | 18.5 | 7.6 |
| | Aluminum chloride (III) | 5 | 4 | 5 | 4–5 | 4 | 18.6 | 11.4 |
| | Zinc chloride | 5 | 4 | 5 | 4–5 | 4 | 18.6 | 12.3 |
| | Bismuth chloride (III) | 5 | 4 | 5 | 4–5 | 4 | 18.7 | 13.1 |
| | Barium hydroxide | 5 | 4 | 5 | 4–5 | 4 | 18.9 | 13.6 |

EXAMPLE 8

Diacetate fiber of 83 dtex/21 f (available from Mitsubushi Rayon K. K.; trade name Linda) and polyethylene terephthalate fiber of 56 dtex/24 f were twisted together at 800 T/M in the Z direction to obtain a warp yarn, and polyethylene terephthalate fiber of 167 dtex/48 f and polyether type polyurethane fiber (available from Asahi Kasei Kogyo K. K.; trade name Loica SC) were twisted together at 1200 T/M in the Z direction while drafting the latter 2.5 times to prepare a weft yarn. The warp and weft yarns were woven into a fabric of a 2/1 twill structure (having a warp density of 148 yarns/inch and a weft density of 77 yarns/inch) in which a mixture ratio of the polyurethane fiber is 2%).

Next, after being scoured at 80° C. and preset at 180° C., the mixed fiber fabric was dyed under the following condition:

Dyeing Condition:

dye: C.I. Disperse Blue 167; 6% omf level dyeing agent: Nikka Sunsalt RM-340: 0.5 g/l acetic acid: 0.5 cc/l sodium acetate: 1 g/l sodium antimony tartrate: 0.2% omf tannic acid: 0.3% omf bath ratio: 1:15 dyeing temperature and time: 130° C., 30 minutes

The dyed fabric was subjected to the reduction clearing treatment under the following condition, and set and finished with dry heat at 180° C. for 30 seconds.

Reduction Clearing Condition:

hydrosulfite: 2 g/l soda ash: 3 g/l

Bisnol UP-10 (available from Ippoh-sha Yushi-K.K.): 1 g/l bath ratio: 1:60 treatment temperature and time: 80° C., 20 minutes

Measured results of the dyed fabric on a color fastness to perspiration-alkali and to washing and the contamination of dry cleaning liquid are shown in Table 8. No color was recognized on the polyether type polyurethane fiber in the dyed fabric.

COMPARATIVE EXAMPLE 9

The same process as in Example 8 was repeated, except that the dyeing is carried out without using tannic acid and sodium antimonyl tartrate. As apparent from Table 8, the dyed fabric of Example 9 is a high quality product excellent in color value, color fastness to perspiration-alkali and to washing, and low in contamination of dry cleaning liquid in comparison with the product obtained from Comparative example 9.

TABLE 8

| | Results of dyed mixed fiber article (Example 8, Comparative example 9) | | | | | | | |
|---|---|---|---|---|---|---|---|---|
| | Co-existence dyeing of tannic acid and antimony | Color fastness to perspiration-alkali | | Color fastness to washing | | | | Degree of color |
| | salt of tartaric acid | Change in color shade | Staining | Change in color shade | Staining | Staining of dry cleaning liquid | Color value (L value) | depth of polyurethane fiber (D) |
| Comparative example 9 | no | 5 | 2–3 | 5 | 3 | 2~3 | 20.2 | 63.4 |
| Example 8 | yes | 5 | 4–5 | 5 | 4–5 | 4~5 | 18.6 | 8.6 |

EXAMPLE 9

Polyethylene terephthalate fiber of 56 dtex/24 f and viscose rayon of 56 dtex/17 f were mixed together by an interlacing treatment and then twisted at 300 T/M in the S direction to form a mixed fiber yarn. A plain knit fabric was prepared from this mixed fiber yarn and polyether type polyurethane fiber (available from Asahi Kasei Kogyo K.K. ; trade name Loica SC) of 33 dtex by means of a 22-gauge knitting machine, wherein the mixture ratio of polyurethane fiber is 2.7% by weight).

Then, after being pre-wetted at 60° C., the knit fabric was preset at 180° C. and dyed under the following condition:

Dyeing Condition:

dye: Dianix Navy Blue (200): 3.5% omf level dyeing agent: Nikka Sunsalt 8000: 1 g/l acetic acid: 0.5 cc/l sodium acetate: 1 g/l tannic acid: 1% omf sodium antimony tartrate 0.5% omf bath ratio 1:20 dyeing temperature and time: 125° C., 30 minutes

After the dyeing, the reduction clearing was carried out under the following condition:

thiourea dioxide: 3 g/l caustic soda: 2 g/l

Bisnol UP-10: 1 g/l bath ratio: 1:60

After the treatment, the dyed fabric was sufficiently washed with water and then dyed under the following condition:

dye: Sumifix Black B: 4% omf

Glauber's salt : 100 g/l soda ash: 20 g/l bath ratio: 1:20 dyeing temperature and time: 60° C., 90 minutes

After being dyed, the dyed fabric is washed with water and soaped at 85° C. After the treatment, the dyed fabric was set and finished with dry heat at 160° C. for 30 seconds.

Measured results of a color fastness to perspiration-alkali, washing and the staining of dry cleaning liquid of the resultant dyed fabric are listed in Table 9. No color was recognized on the polyether type polyurethane fiber therein.

COMPARATIVE EXAMPLE 10

The same process as in Example 9 was repeated, except that the dyeing with disperse dye is carried out without using tannic acid and sodium antimonyl tartrate. As apparent from Table 9, the dyed fabric of Example 11 is a high quality product excellent in color value, color fastness to perspiration-alkali and to laundering and low in contamination of a dry cleaning liquid in comparison with the product obtained from Comparative example 10.

TABLE 9

Results of dyed mixed fiber article (Example 9, Comparative example 10)

| | Co-existence dyeing of tannic acid and sodium antimony tartrate | Color fastness to perspiration-alkali | | Color fastness to washing | | Staining of dry cleaning liquid | Color value (L value) | Degree of color depth of polyurethane fiber (D) |
|---|---|---|---|---|---|---|---|---|
| | | Change of color shade | Staining | Change in color shade | Staining | | | |
| Comparative example 10 | no | 5 | 2~3 | 5 | 3 | 2~3 | 17.4 | 60.4 |
| Example 9 | yes | 5 | 4~5 | 5 | 4~5 | 4~5 | 16.9 | 7.4 |

CAPABILITY OF EXPLOITATION IN INDUSTRY

The mixed fiber article dyed with disperse dye, composed of disperse dyeable fiber and polyurethane fiber according to the present invention provides a deeply dyed mixed fiber article containing polyurethane fiber which is one excellent in color fastness to perspiration-alkali and to washing and low in contamination of dry cleaning liquid as well as having a high color value (color depth) and wet color fastness.

What is claimed:

1. A dyed mixed fiber article composed of fiber dyeable with disperse dye and polyurethane fiber that is not an elastomeric polyester ether fiber wherein the dyed mixed fiber article has a color fastness to a perspiration-alkali according to the JIS L-0848-A Method of grade 3 or higher and a dyed color shade of 20 or less in terms of L value determined by a spectro-colorimetry, and is dyed with a disperse dye.

2. A dyed mixed fiber article according to claim 1 wherein the disperse dye is a benzolic azo disperse dye.

3. A dyed mixed fiber article according to claim 1, wherein the dyed mixed fiber article has a color fastness to a perspiration-alkali according to the JIS L-0848-A Method of grade 4 or higher, and is dyed with a disperse dye selected from a heterocyclic azo disperse dye, condensation disperse dye and diester disperse dye.

4. A dyed mixed fiber article according to any one of claims 1–3 wherein the degree of pigmentation⊕ of the polyurethane fiber contained in the dyed mixed fiber article is 60 or less.

5. A dyed mixed fiber article according to any one of claims 1–3 wherein the dyed mixed fiber article has an measured value of grade 3 or higher in contamination of a dry cleaning liquid according to the JIS L-0860 Method.

6. A method for dyeing a mixed fiber article composed of fiber dyeable with disperse dye and polyurethane fiber that is not an elastomeric polyester ether fiber comprising sequentially treating the mixed fiber article in a bath containing both tannic acid and polyvalent metallic compound and dyeing the mixed fiber article with a disperse dye or dyeing the mixed fiber article in a dye bath containing disperse dye in the presence of tannic acid and polyvalent metallic compound.

7. The method of claim 6 wherein the treating and dyeing steps are performed sequentially.

8. A method for dyeing a mixed fiber article according to either claim 6 or 7 wherein the polyvalent metallic compound is at least one selected from an antimony compound, a tin compound, an aluminum compound, a zinc compound, a barium compound, and a bismuth compound.

9. A method for dyeing a mixed fiber article according to either claim 6 or 7 wherein the polyvalent metallic compound is an antimony compound.

10. A method for dyeing a mixed fiber article according to claim 9 wherein the disperse dye is a benzolic azo disperse dye.

* * * * *